United States Patent [19]

Day et al.

[11] Patent Number: 4,897,982

[45] Date of Patent: Feb. 6, 1990

[54] PLASTIC LINED PACKAGING

[75] Inventors: Victor S. Day, Spofford, N.H.; David A. Collette, Greenfield, Mass.

[73] Assignee: Fulflex International Co., Limerick, Ireland

[21] Appl. No.: 258,563

[22] Filed: Oct. 17, 1988

[51] Int. Cl.[4] ..... B65D 85/16; B65B 1/04

[52] U.S. Cl. ..... 53/449; 53/429; 53/473; 206/388; 220/404

[58] Field of Search ..... 53/452, 456, 429, 449, 53/473; 206/388, 389, 409, 410; 220/403, 404, 461–463

[56] References Cited

U.S. PATENT DOCUMENTS

| | | | |
|---|---|---|---|
| Re. 29,272 | 6/1977 | Hintz et al. | 165/208 |
| 2,719,351 | 10/1955 | Drummond | 53/429 |
| 2,834,092 | 5/1958 | Drummond et al. | 53/429 |
| 2,863,208 | 12/1958 | Drummond et al. | 53/429 |
| 3,065,895 | 11/1962 | Lipschutz et al. | 220/403 |
| 3,254,467 | 6/1966 | Garrow et al. | 53/449 |
| 3,285,721 | 11/1966 | Ewing | 206/388 |
| 3,351,992 | 11/1967 | Carter | 53/429 |
| 3,392,825 | 7/1968 | Gale | 220/404 |
| 3,509,687 | 5/1970 | Fleissner | 53/429 |
| 3,729,367 | 4/1973 | Shore et al. | 53/429 |
| 3,756,494 | 9/1973 | Becker, Jr. et al. | 220/404 |
| 4,052,931 | 10/1977 | Morse et al. | 93/36.01 |
| 4,202,450 | 5/1980 | Howell et al. | 206/459 |
| 4,288,999 | 9/1981 | Sterling et al. | 53/449 |
| 4,349,571 | 9/1982 | Davis et al. | 426/124 |
| 4,435,434 | 3/1984 | Caporaso | 426/108 |
| 4,441,948 | 4/1984 | Gillard et al. | 156/189 |
| 4,585,501 | 4/1986 | Overholt | 156/205 |
| 4,622,693 | 11/1986 | Mykleby | 383/119 |
| 4,688,674 | 8/1987 | Stirtz | 206/388 |

*Primary Examiner*—Jimmy G. Foster

*Attorney, Agent, or Firm*—Darby & Darby

[57] ABSTRACT

A plastic bag lined container is disclosed which includes four sides, a bottom and a top, with the container including a plastic bag liner loosely disposed therein which at least covers the container sidewalls. Incorporating a plastic liner in the container for discharge of elastic tapes or threads substantially reduces friction against the sidewalls during high speed discharge, while providing air pockets for even packing along the sidewalls, achieving uniform tension in the material during discharge to assure relatively precise elastic elongation in final products wherein the elastic tapes or threads are used.

4 Claims, 2 Drawing Sheets

PLASTIC LINED PACKAGING

TECHNICAL FIELD

This invention relates to packaging for elastic tapes and threads and more particularly to plastic lined packaging for easing the discharge of elastic tapes and threads from a container reducing tension or thread breakage.

BACKGROUND

Generally, various elastic tapes and threads are used to produce resilient bands in various types of articles or garments. For example, in U.S. Pat. No. 4,626,305 to Sukuri et al., disposable diapers are disclosed which include individual elastic tapes or threads which are pulled from a container and threaded into a diaper for providing a resilient snug fit. Generally, most applications requiring such tapes or threads utilize some type of roller apparatus to pull the material out of a container. Once through the roller, a wide range of devices such as metering, pre-stretching, splitting and gluing devices may be used to adapt the elastic tapes or threads for incorporation in an article.

A common requirement for the various applications is to maintain the elastic tapes or threads at a controlled elongation when they are incorporated into the article, as any variation in elongation would cause variable elastic tension in the finished product, resulting in a defective product which would be either too loose or too tight for the particular application.

Though various devices may be utilized to incorporate elastic tapes or threads in products, a common source for variations in the elastic tension occurs during discharge of the tapes or threads from the source container. Such tension occurs due to friction or rubbing of the tapes or threads against the container sidewalls during discharge or due to tangles which generally occur within the container through rough handling in transport. Such friction or tangling may cause the threads to tug against the sidewall, setting up a cyclic variation as the thread becomes trapped, released and trapped again. Such tugging may be severe enough to cause the tape or thread to break, halting production and requiring restring-up of the equipment.

SUMMARY OF THE INVENTION

It is an object of the present invention to limit friction during discharge of tapes or threads from a container.

It is a further object of the present invention to limit the occurrence of tangling which may be caused by rough handling.

It is yet another object of the present invention to provide a container which reduces friction or tangling without requiring substantial redesign of the container.

It is a further object of the present invention to provide a container which is compatible with existing discharge devices for pulling elastic tapes and threads from containers.

It is yet another object of the present invention to provide a container which is easily manufactured at low cost while allowing substantial increases in product uniformity without requiring auxiliary mechanical devices.

According to the present invention, a plastic lined container is disclosed which includes four sides, a bottom, and a lid, the box including a plastic bag liner loosely placed therein.

Utilizing a plastic bag liner, such as a polyethylene bag, substantially reduces the friction between the elastic tape or a thread pulled from the box when rubbing against the sidewalls. In addition, utilizing the bag liner in a container for elastic tapes or threads substantially reduces the tangling which occurs during rough transport of the container from the manufacturer to the user. Since the bag is loosely placed in the container, some air pockets form during filling between the bag and the sidewalls, providing space for the elastic material to settle without tangling. Utilizing a plastic bag lined container provides a simple solution, inexpensive to incorporate in a container, requiring no substantial modifications of the container or of the discharge systems. The results are quite surprising as it would not be expected that simply incorporating a plastic bag loosely in a container for discharge of elastic tapes or threads could reduce tangling in a package during shipping.

DETAILED DESCRIPTION OF THE INVENTION

Figure 1:
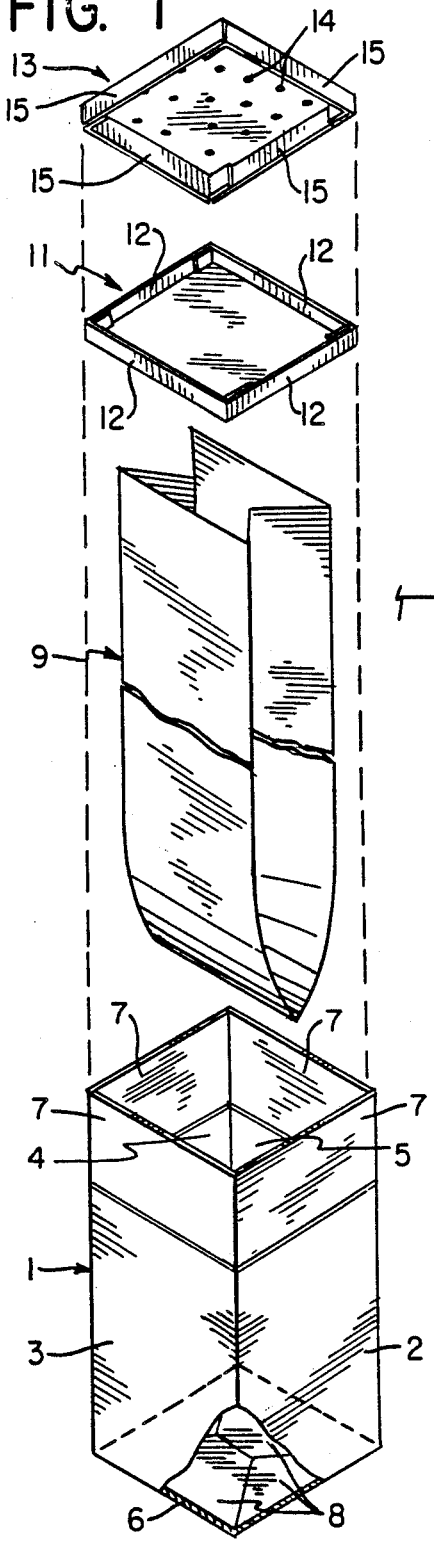
FIG. 1 is an exploded view of a plastic lined container according to the present invention.

Referring to FIG. 1, a plastic bag lined container 1 for transport and discharge of elastic tapes or threads is shown. The container 1 includes sidewalls 2, 3, 4 and 5, a bottom 6 and opposing top flaps 7. Generally, the container is of conventional construction yet is sized and shaped particularly for the transport and discharge of elastic tapes or threads therefrom. For example, the container may be composed of a corrugated Kraft paper material and be about 18" high by 12" wide by 12" deep.

Generally, a corrugated container blank is first received and properly folded into the shape of a box. Referring to FIG. 1, the container 1 includes the bottom 6 formed from four flaps 8, foldable in an interlocking relation to form the bottom 6, with the flaps possibly taped or stapled to provide a strong bottom. A plastic liner 9, composed of polyethylene, preferably low density polyethylene, and having a thickness of about 0.00175 inch is provided as, essentially, a bag having a full tubular construction with a gussetted bottom 10 which is heat-sealed. While a tubular bag structure is preferred, a loosely placed liner which at least covers the container sidewalls may be used. For example, a plastic tube opened at the bottom and top may be placed in the container and pressed against the sidewall. While effective, such a construction is inconvenient to incorporate in a container as will be described below. For the container previously described, a liner having a 38" height by 12½" wide by 12½" deep construction may be used.

Referring still to FIG. 1, a guide 11 is provided for assuring proper placement of the bag liner within the container. The guide for the above described container and liner may comprise a 12" by 12" square piece of corrugated paper of similar construction to the container itself which is inserted into the liner and then the liner and guide are fitted into the container. The guide 11 and liner 9 rest on the bottom 6 of the container 1, with the guide assuring that the liner is against the four sidewalls. The guide 11 may include short sidewalls 12, as shown in FIG. 1, but these are optional. The bag liner is usually draped over the top flaps 7 of the box during loading of an elastic tape or thread into the container. Of course, a guide need not be used if an open tube construction is provided.

The container of the present invention is particularly designed for transport and discharge of elastic tapes or threads. Generally, lengths of up to about 30,000 yards of elastic tape are fed into the container from apparatus for preparing and drawing the tapes and threads. Generally, the material is loosely packed within the container rather than placed on spools or other such devices. After the container has been filled with a particular quantity of tape, most conveniently measured by weight, a top tray 13 is placed on top of the material, with the extending liner portion twisted or otherwise closed and placed on top of the tray. The top tray 13 is of similar construction to the container, i.e. composed of Kraft paper, including foldable flaps 15 for forming supporting sidewalls. After placement of the tray in the container and closing of the bag, the top flaps 7 are engaged to close the container. Generally, the flaps are interlocked, taped, stapled in order to assure that the container does not open.

During transport to a user's facility, the container is usually jostled either mildly or severely. As may be imagined, such jostling of the loose elastic tapes and threads could produce substantial tangling. Once the container arrives at the user's facility, it is placed adjacent apparatus for withdrawing the tape or thread from the container for direct use in a product incorporating elastic tapes or threads therein. Illustrative apparatus is disclosed in U.S. Pat. No. 4,626,305 to Suzuki et al, as previously described.

Figure 2:
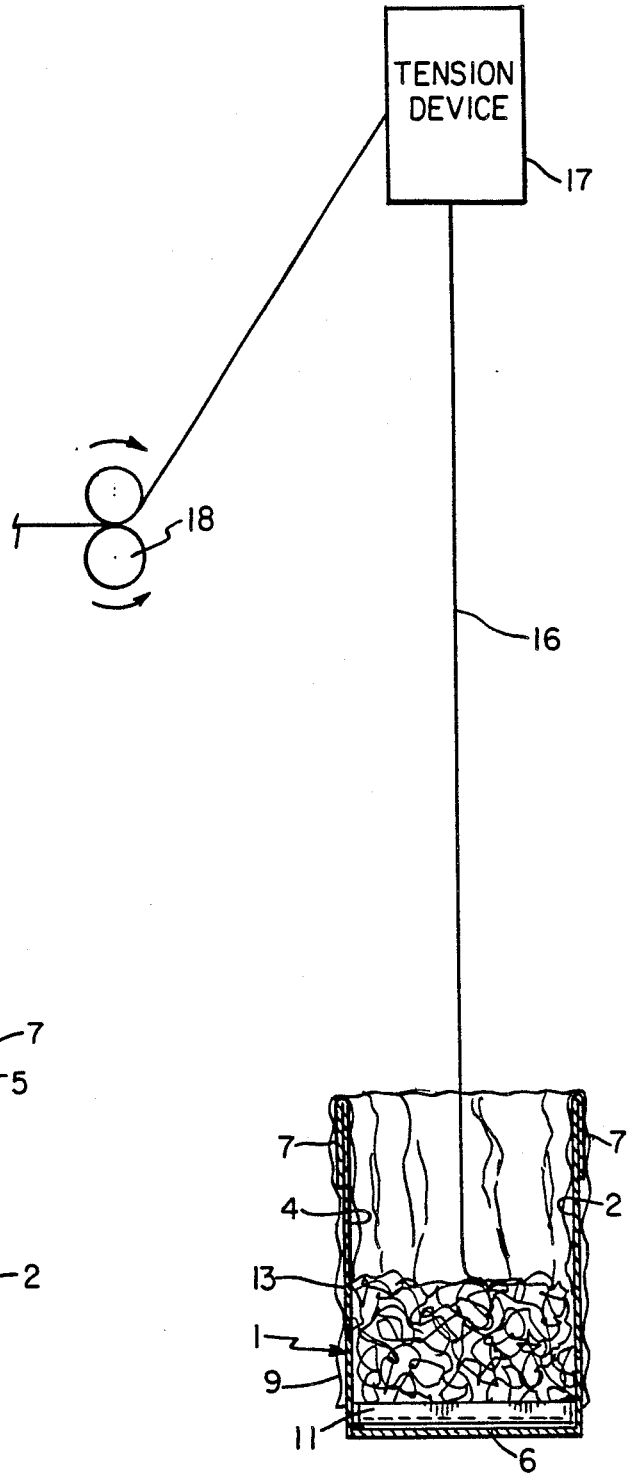
FIG. 2 is a illustrative view of a typical tape or thread discharge system which involves pulling an elastic tape or threads from a container through a nip roller.

Generally, the top flaps 7 of the container are disengaged and the liner 9 again draped over the top flaps to expose the elastic material contained therein. Referring to FIG. 2, the container 1 has a bag liner 9 and includes elastic threads or tape 16 placed beneath a tensioning device 17 which is used to dampen tension spikes. Such a device dampens, rather than eliminates spikes, as does the present invention. A single thread or tape 16 is drawn from the container by nip rollers 18, with the thread then used by other devices (not shown) for incorporation in an article. Utilizing a plastic bag lined container has substantially reduced the tugs or traps which occur, illustrated by tension spikes, during discharge from the container.

TABLE I

| Net Weight, lbs | Time Shake, hrs | Box Open Dist. Tray Up, Inches | Box Open Material Depth, Inches | Trapped Ends | Tension Spikes | Breaks |
|---|---|---|---|---|---|---|
| 34 | 1 | 0 | 2–3 | yes | yes | 0 |
| 37 | 1 | 0 | 2 | yes | yes | 0 |
| 38 | 1 | ¼ | ¾–1 | 0 | yes | 0 |
| 39 | 1 | ¾ | 1½–2 | 0 | yes | 0 |
| 40 | 1 | ¾ | 1½–2 | 0 | yes | 0 |
| 40½ | 1 | ¾–1 | 1½ | 0 | yes | 0 |
| 41 | 1 | 1¼ | 1 | 0 | yes | 0 |
| 42 | 1 | 1–¾ | ¾ | 0 | yes | 0 |
| 41 | 8 | ¾ | 1 | 0 | yes | 0 |

Referring to Table I, various weights of material are shown which were placed in a standard unlined container including a standard 3" high tray and shaken from 1–8 hours. The heading "Box Open Dist. Tray Up, Inches" refers to the distance (in inches) which the tray moves up upon opening of the box caused by the prior compression of the material while being loaded into the box. The "Box Open Material Depth, Inches" heading refers to the depth of the material below the top of the box (in inches) measured after removal of the tray from the box.

The material was pulled out of the box with the tension of the material monitored to determine whether tension spikes occurred. Various weights were chosen to determine whether or not varying the weight of the material in the box would eliminate the tension spikes. While the weights varied from 34 to 42 pounds per container, tension spikes occurred in every weight category. However, tension spikes increased from 40½ pounds and up, due to pressure of the elastic material against the sides of the container, causing excess friction. Tension spikes were evident at all weights, yet no trapping was noted which would cause a breakage. The ranking by performance was: 39, 40, 40 ½, 38, 37, 41, 42, 34. At the low weight, the material became stuck in the tray holes, which is believed to indicate excessive movement at the top of the container. Also, lower weights tended to run with less tension spikes but were more prone to tangling.

TABLE II

| Net Wt. Lbs. | Time Shake Hrs. | Tray In. | Box Open Dist. Tray Up, In. | Box Open Material Depth, In. | Trapped Ends | Tension Spikes | Breaks |
|---|---|---|---|---|---|---|---|
| 40 | 1 | 12⅛ × 12⅛ × 3 | 1 | 1¼ | 0 | yes | 0 |
| 40 | 1 | 12 × 12 × 3 | 1 | 1¼ | 0 | yes | 0 |
| 40 | 1 | 12 × 12⅛ × 3 | 1 | 1¼ | 0 | yes | 0 |
| 36 | 1 | 6 × 12⅛ × 12⅛ | N/A | 1½ | 0 | yes | 0 |
| 37 | 1 | 6 × 12⅛ × 12⅛ | N/A | 1 | 0 | yes | 0 |
| 37 | 1 | 6 × 12⅛ × 12⅛ | N/A | 1¾ | 0 | yes | 0 |

TABLE II-continued

| Net Wt. Lbs. | Time Shake Hrs. | Tray In. | Box Open Dist. Tray Up, In. | Box Open Material Depth, In. | Trapped Ends | Tension Spikes | Breaks |
|---|---|---|---|---|---|---|---|
| 38 | 1 | 6 × 12⅛ × 12⅛ | N/A | 2⅛ | 0 | yes | 0 |

Referring to Table II, different tray dimensions and depths were tested to determine whether the change in these dimensions could prevent tray movement and reduce tension spikes. In addition, various weights were also tried with various tray dimensions in order to determine if the combined changes could reduce tension spikes. It was found that while some improvements were shown in some areas, tension spikes continued to occur, regardless of tray design.

TABLE III

| | | Polyethylene Sleeve vs. Standard | | | | | |
|---|---|---|---|---|---|---|---|
| Net Wt. Lbs. | Time Shake Hrs. | Tray In. | Box Open Dist. Tray Up, Ins | Box Open Material Depth, In. | Trapped Ends | Tension Spikes | Breaks |
| 40 poly liner | 5½ | 3 | 1 | 0 | 0 | no | 0 |
| 40½ w/o liner | 1 | 3 | 1 | ¼ | 0 | yes | 0 |

Figures 3A, 3B:
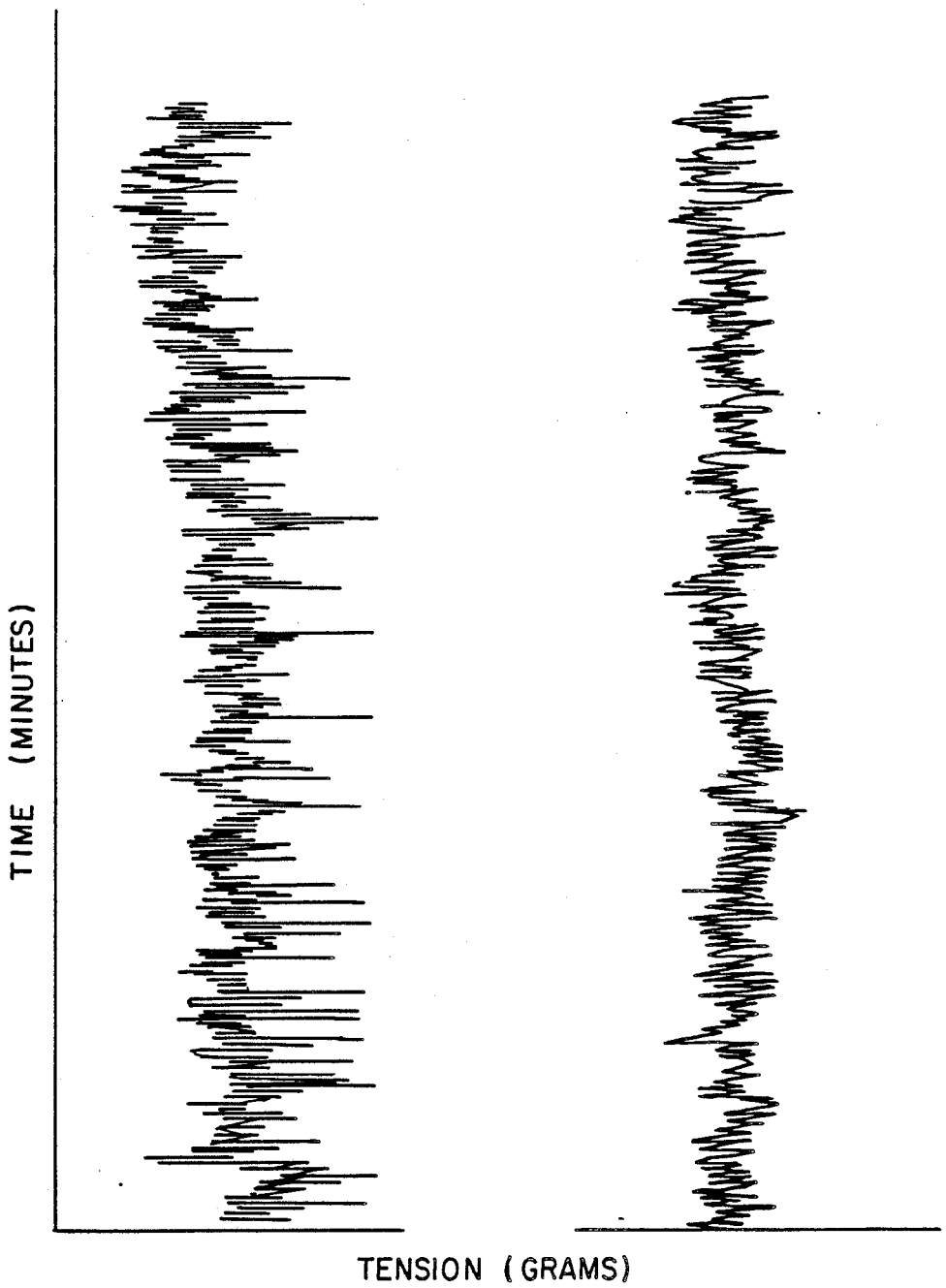
FIG. 3A is a graph showing tension spikes which occur in an unlined container.
FIG. 3B is a graph showing essentially constant tension which occurs in the bag lined container of the present invention.

Referring to Table III a polyethylene bag lined container was compared to a standard container including 40 pounds of elastic material therein. For this test, the material in the polyethylene bag lined container was shaken for substantially more time than the unlined container (5.5 vs. 1 hours). The results of this test are shown graphically in FIGS. 3A and 3B. FIG. 3A shows the tension spikes which occurred in the standard unlined container including 40½ pounds of material utilizing a 3-inch standard tray. Tension spikes are considered as any individual peak which extends beyond a normal tension pattern. As is evident, there were a substantial number of tension spikes which are believed to have been caused by tugging or trapping within the container due to excessive friction. Referring to FIG. 3B, the results are shown utilizing a polyethylene bag liner and a standard container including 40 pounds of material which was shaken for 5½ hours. As is evident, no tension strikes occurred during discharge of the elastic material from the container. This is quite surprising as the amount of shaking should have substantially tangled the material and caused some tension spiking to occur. However, it is believed that a lack of friction between the elastic material and the polyethylene bag liner allows the material to more evenly pack within the container rather than become hung up along the sidewalls and jumbled. The material is quickly and easily removed from the container and provides excellent uniformity in high speed discharge for use in finished products.

TABLE IV

| Box Type | Minutes Run | Tension Spikes | Spikes/Minute |
|---|---|---|---|
| "Plastic Coated" | 53 | 30 | 0.57 |
| Unlined | 47 | 32 | 0.68 |
| Polyethylene Liner | 58 | 2 | 0.034 |

Referring to table IV, the results of a comparison test of the polyethylene bag lined container to an adhered plastic lined container is shown. The adhered plastic liner comprised a polyethylene bag liner glued to the sidewalls of the container to simulate a plastic coated container and determine if friction alone was the cause of tension spikes. From the results, it is evident that plastic coating alone is inadequate to eliminate the tension spikes. It is believed that the presence of air pockets along the side walls between the bag and the wall allows some room for packing of the elastic material after loading. Therefore, a loosely placed plastic bag is required to practice the invention.

Incorporating a polyethylene bag liner in a container for transporting and discharge of elastic materials provides substantial improvements over the existing system using standard corrugated containers. Such results are quite surprising as there is no indication that the reduction of friction within a container could produce such uniformity in discharge, and certainly there was no suggestion that a loose bag would prove more effective than a coated container. Such a solution to this long-standing problem is quite simple to incorporate in existing containers and is quite economical considering the substantial improvement in discharge which will result. Consequently, while a relatively simple solution, it is indeed an advance in the art.

While this invention is discussed in relation to a polyethylene bag lined corrugated container, it will be understood by those skilled in the art that various changes or modifications could be made without varying from the scope of the present invention.

What is claimed is:

1. A method for discharging elastic material from a container at high speed without tugging or trapping of the elastic material, the method comprising:

providing a container sized and shaped for the transport and discharge of elastic material;

placing a bag liner loosely within the container, the liner composed of a plastic material which reduces friction between the elastic material and the sidewalls while providing air pockets for even packing along the sidewalls;

filling the lined container with the elastic material; and, pulling the elastic material out of the lined container.

2. The method of claim 1 wherein the container includes four sides, a bottom and a top.

3. The method of claim 1 wherein the liner is composed of low density polyethylene.

4. The method of claim 1 wherein the container is composed of a corrugated kraft paper material.

* * * * *